US007431079B1

(12) United States Patent
Chavez

(10) Patent No.: US 7,431,079 B1
(45) Date of Patent: Oct. 7, 2008

(54) RETRIEVABLE OIL AND OR GAS WELL BLOWOUT PREVENTER

(76) Inventor: Manuel Chavez, 9595 W. Quincy Ave., Littleton, CO (US) 80123

( * ) Notice: Subject to any disclaimer, the term of this patent is extended or adjusted under 35 U.S.C. 154(b) by 0 days.

(21) Appl. No.: 11/121,725

(22) Filed: Aug. 1, 2005

Related U.S. Application Data

(60) Provisional application No. 60/573,034, filed on May 21, 2004.

(51) Int. Cl.
*E21B 33/12* (2006.01)

(52) U.S. Cl. ..... 166/139; 166/135; 166/192; 166/194

(58) Field of Classification Search ..... 166/135, 166/192, 194, 139
See application file for complete search history.

(56) References Cited

U.S. PATENT DOCUMENTS 901,874 A * 10/1908 Burgess ..... 166/123
2,122,742 A * 7/1938 Hanes ..... 166/134
2,355,199 A * 8/1944 Bassinger ..... 166/128
2,808,890 A * 10/1957 Arthur et al. ..... 166/192
3,000,443 A * 9/1961 Thompson ..... 166/135
3,387,659 A * 6/1968 Current ..... 166/125
3,860,067 A * 1/1975 Rodgers ..... 166/121
4,533,036 A * 8/1985 Gordon ..... 198/499

* cited by examiner

*Primary Examiner*—Giovanna C Wright
(74) *Attorney, Agent, or Firm*—Albert D. Haegele; Leyendecker + Lemine, LLC

(57) ABSTRACT

A well blowout prevention apparatus that can be inserted into the well bore of a subterranean well, to confine fluid in the well when the fluid experiences or exerts a pressure surge, is described. Methods of using the well blowout prevention apparatus are also described. The apparatus is adapted to be manipulated from above by a pipe-string or other instrument, to readily disengage from the inner well casing wall, and to be retrievable from inside the well bore.

15 Claims, 4 Drawing Sheets

RETRIEVABLE OIL AND OR GAS WELL BLOWOUT PREVENTER

This application claims benefit of application Ser. No. 60/573,034 filed May 21, 2004.

BACKGROUND OF THE INVENTION

Field of the Invention

The present invention relates to subsurface oil well tools. And more specifically to well apparatus for automatically controlling escaping hydrocarbons and natural gases, ($CO_2$, etc.), due to well head malfunction/destruction caused by terrorism, war, natural or manmade disasters, accidental or intentional. More commonly known as a "blowout". The invention is a retrievable pressure sensitive valve assembly for oil and/or gas well blowout prevention, comprising of an upper assembly, either threaded or with a locking device used to attach the invention to piping in order to place said invention to the proper depth within a cased well bore, preferably above the casing perforations, or to be determined by the production/petroleum engineer or company, a lower assembly, an elongated plunger type valve, an independent adjustable valve collar with a means of fastening to the valve stem, an upper valve stem guide, a lower valve stem guide, two threaded pins that allow the upper and lower assemblies to be secured together, various sized "O" rings, two inner double grooved seals, and four "set dies" with four shearable pins, made of hardened steel or suitable material, as described in the accompanying drawings.

SUMMARY OF THE INVENTION

An objective of the invention is to provide an apparatus for prevention of oil and/or natural gas well blowout, (hydrocarbons, natural gases, ($CO_2$, etc.), from escaping due to well head malfunction, terrorism, war, natural or manmade disasters, by being attached to the production tubing or at any depth in the casing above the well perforations, thus providing safety and security of the well. This device will automatically save millions of dollars of natural resources, and negate the need for oil well firefighters and blowout specialists. This device is easily repairable and installation is simple compared to similar devices in production and use today, if any.

An objective of the invention is to provide an apparatus for the controllability of hydrocarbons, natural gases, $CO_2$, etc., from being released uncontrollably due to well head malfunction/destruction, terrorism, war, natural or manmade disasters, either accidental or intentional in nature, by being able to "set" this apparatus separately above the casing perforations by utilizing a "J-LOCK" or similar internally grooved principle.

An objective of this invention is to provide an adjustable plunger type valve, by exploitation of an independent adjustable valve stem collar, thus enabling the valve to be adjusted the desired distance between the valve seat.

An objective of the invention is to provide an avenue to release the valve from its seat once the valve is employed and the well head is properly repaired, by using hydraulic pumping action through the use of a pump capable of unsetting and equalizing the formation pressure.

An objective of this invention is to provide another avenue to release the valve from its seat through the use of a wire line, sinker bar, and a bumper sub assembly, by using a sand line and lubricator once the well head has been properly repaired. The well servicing crew will fill the tubing with fluid, with the pump on standby, and then use the sand line principle to release the valve from its seat and to equalize the pressure differential at the well head by using a choke valve until the desired pressure and flow is achieved.

An objective of the invention is to provide an avenue of being able to position this internally grooved apparatus at any depth according to the size of the invention and casing inside diameter, by the employment of the retractable "set dies" that are employed by turning the well tubing in a clockwise direction until seated in the inner well casing bore above the well perforations. To properly place this oil tool into the well casing bore at the desired depth will require the skill of the rig operator and the oil tool employee on the rig floor.

An objective of this invention is to be able to "unset" this apparatus by the employment of retractable "set dies" that are unemployable by turning the well tubing in a counterclockwise direction until unseated. To properly "unseat" this oil tool will require the skill of the rig operator and the oil tool employee on the rig floor.

An objective of this invention is to be able to "gut out" this apparatus due to the possibility of being unable to "unset" this device, through these required steps. Step 1: Utilizing the sand line (wire line) procedure to "gut out" this device using a sinker bar of the appropriate diameter and bumper-sub and other tools to shear the independent valve stem adjuster set screw or pin, allowing the elongated valve, and valve guides to fall out the bottom of this device, leaving the inside hollow. Step 2: To "spear" this device with the use of fishing tools (a spear or inside grappler) and a bumper-sub to shear the shear pins that are holding the "set dies" in the appropriate places built into this device, thus, enabling the rig operator to "fish" this device out of the hole. If in the event that this device is unable to be "fished out", it can be forced past the casing perforations into the "rat hole" and abandoned.

An objective of this invention is to be able to treat a well through this device.

An objective of this invention is to provide a suitable tubing anchor that is provided by employing the retractable "set dies", thus, possibly eliminating the need for a separate tubing anchor, saving substantial operating costs.

This invention is not reliant on other existing patents at this time.

This device can automatically stop the flow of crude oil and/or natural gases from its source into the atmosphere due to damage to the well head in an expeditious fashion. Due to its economical design and its construction of high strength material and its various resistance to temperature and pressure, it is an ideal oil and/or natural gas well blowout prevention device. Due to the simplicity of design which utilizes the minimal use of mechanical components, the cost efficiency is advantageous.

The ease in which installation occurs places this invention as a forerunner in design and function over existing similar devices, if any.

It is the primary objective of this invention to provide a method for oil and/or natural gas well blowout prevention, due to well head malfunction/destruction, terrorism, war, natural or manmade disasters, in which a minimum loss of crude oil and/or natural gas is achieved. Combined, this feature with the ability of having a device that is easily machined with a lathe and easily repaired at a reasonable cost with the simplicity of design makes this device unique and genuine in nature. This device has a high degree of quality and reliability incorporated into its design.

This invention possesses many other advantages, and has other objectives of the invention contributing to dependability in use for long periods and under adverse conditions will be more fully understood from the following detailed description of a preferred embodiment of the invention, when taken in conjunction with the accompanying drawings in which:

DETAILED DESCRIPTION OF THE INVENTION

Figure 1:
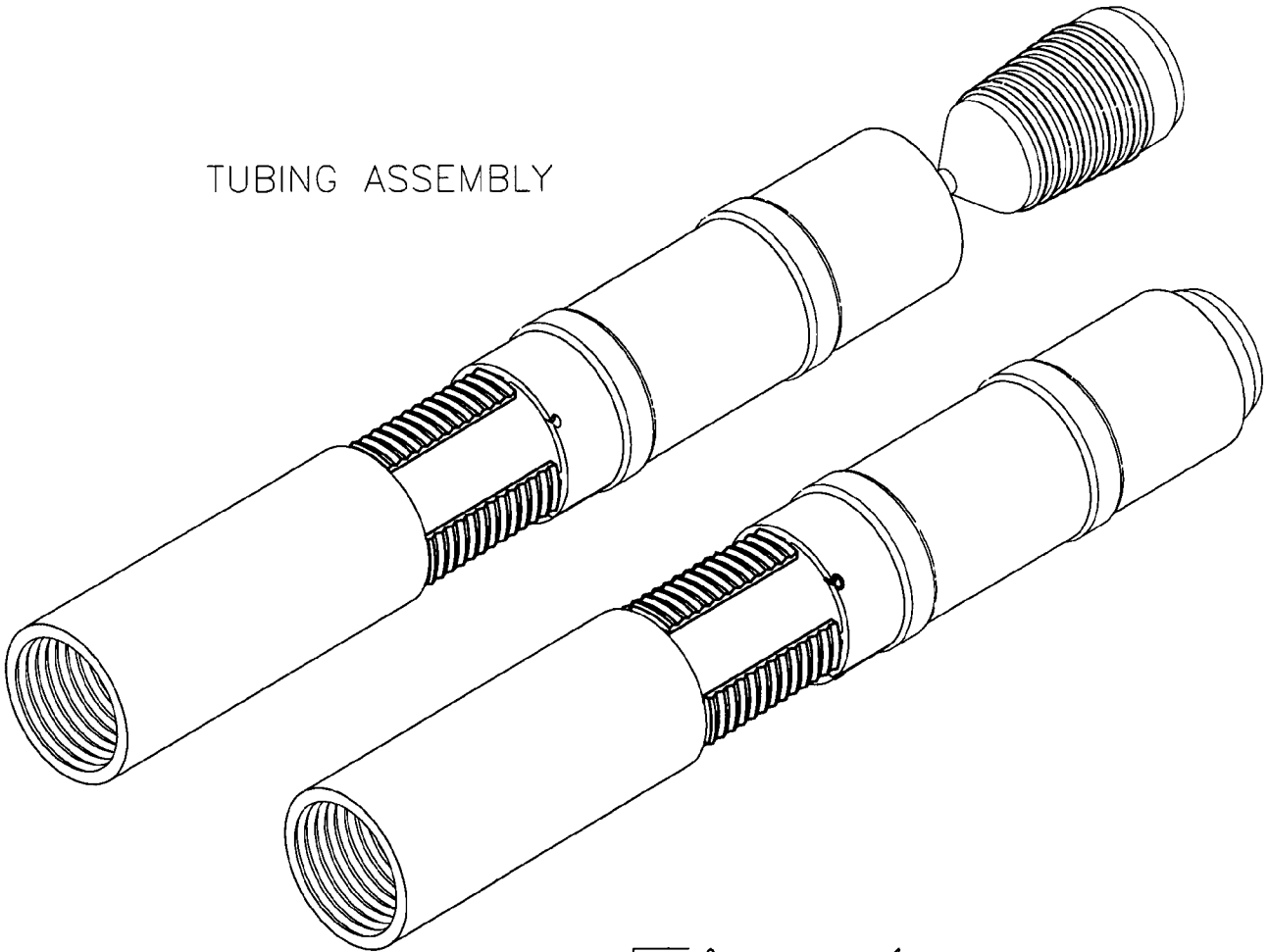
FIG. 1 is an isometric view of this invention, thereby showing the tubing assembly. In the upper drawing of FIG. 1, the blowout preventer is shown in the open position. In the lower drawing of FIG. 1, the blowout preventer is in the closed position.
Figure 2:
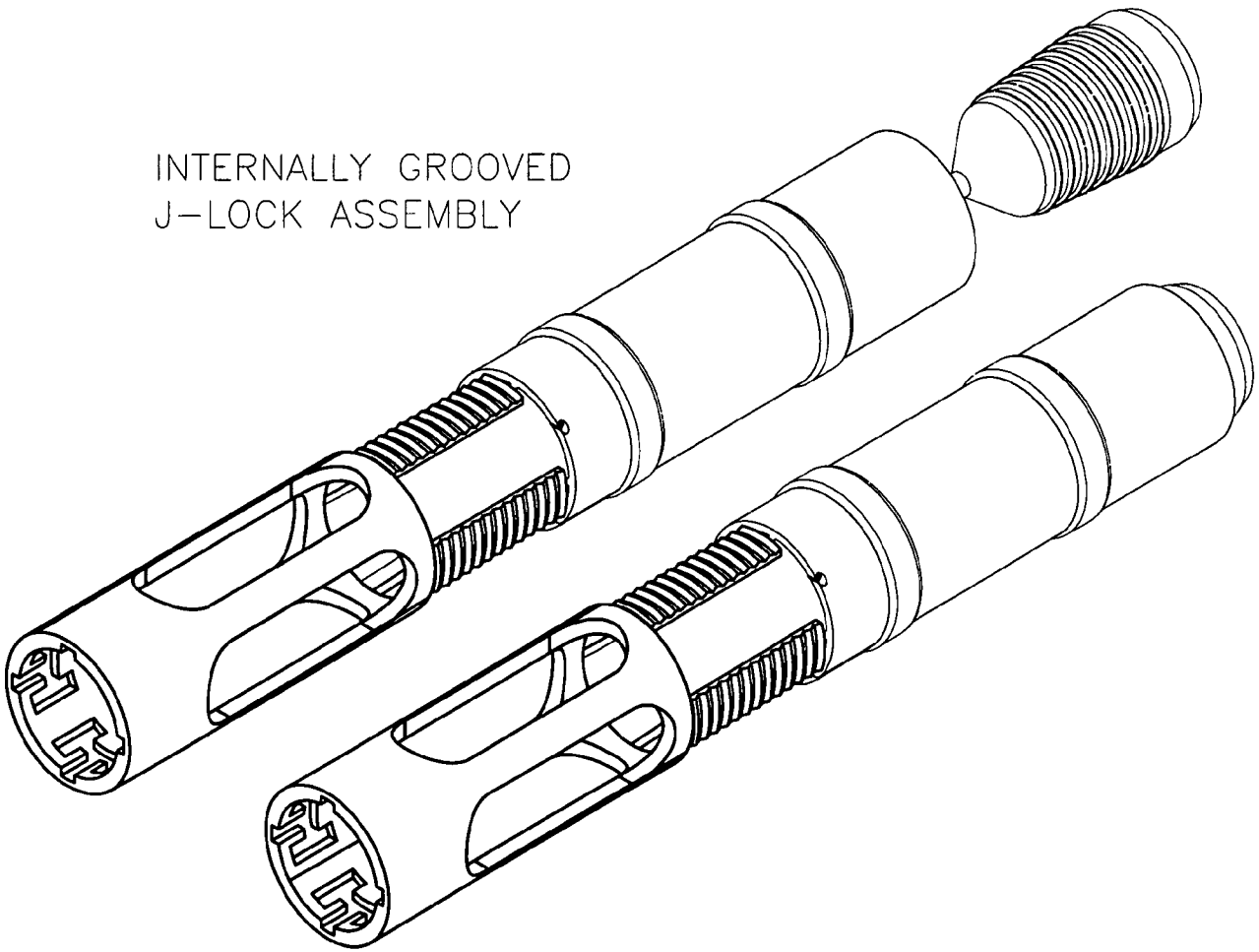
FIG. 2 is an isometric view of this invention, thereby showing the internally grooved "J-LOCK" assembly. In the upper drawing of FIG. 2, the blowout preventer is shown in the open position. In the lower drawing of FIG. 2, the blowout preventer is in the closed position.
Figure 3:
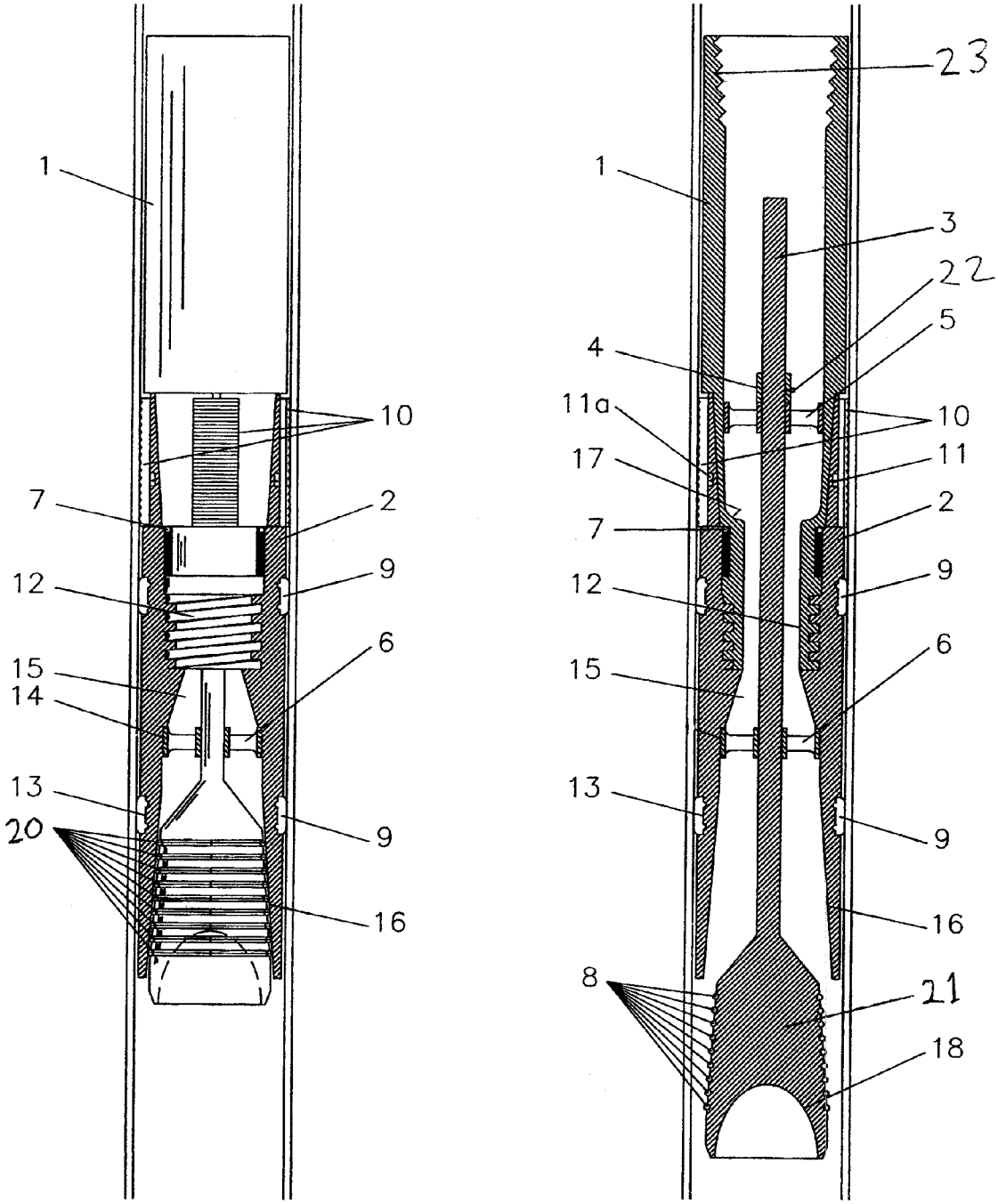
FIG. 3 is a vertical section showing the retrievable oil and/or gas well blowout preventer valve assembly with the preferred embodiment of FIG. 1.
Figure 4:
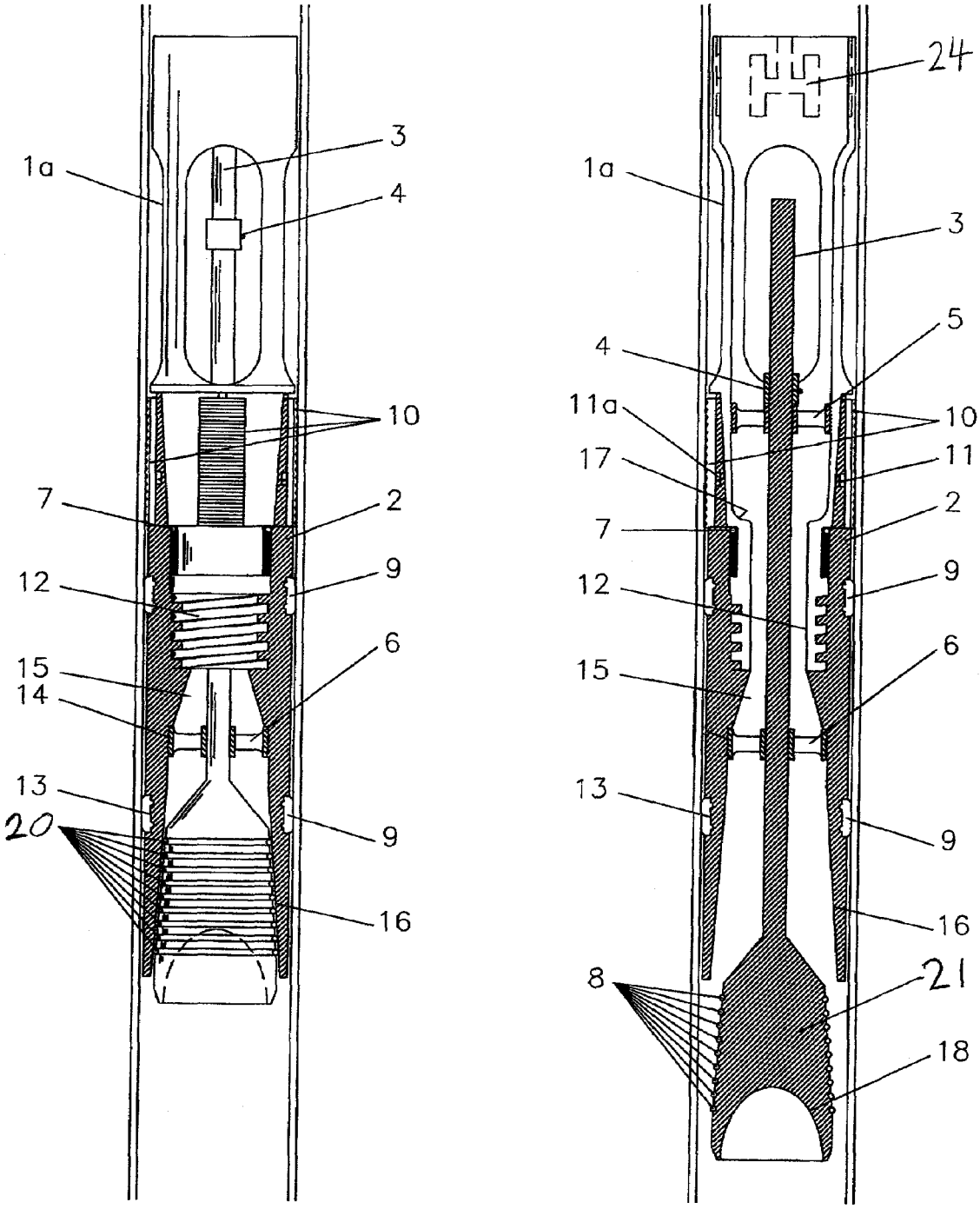
FIG. 4 is a vertical section showing the retrievable oil and/or gas well blowout preventer valve assembly with the preferred embodiment of FIG. 2.

In one embodiment, it will be observed in FIGS. 3 and 4, that the upper housing member (1), (1*a*) of this invention is coarsely threaded (12) into the lower housing member (2) and is then secured integrally by the course threads (12) and the two threaded locking pins (7).

A principal component of the integral valve assembly is an inner chamber (15) comprising of the joining of the upper housing member (1), (1*a*) and the lower housing member (2) which during a well blowout will cause a vacuum action in the inner chamber that will draw the valve body (21) into the valve seat (16) ceasing the unwanted, uncontrollable, oil and/or gases from reaching the atmosphere in an uncontrollable manner due to the absence of the well head. The upper housing member (1), (1*a*) includes an upper valve guide (5). (FIGS. 3 and 4). The upper valve guide (5) includes in unitary integral relation, a pair of oppositely extending radial arms projecting from a bushing or bearing sleeve having a central vertical bore (FIGS. 3 and 4). The lower housing member (2) includes a lower valve guide (6). The upper and lower valve guides (5), (6) include in unitary integral relation, a pair of oppositely extending radial arms projecting from a bushing or bearing sleeve having a central vertical bore. The lower housing member (2) includes two outer double grooved margins (13) to accept two lower assembly resilient seals (9) made of rubber-like material.

With specific reference to FIGS. 3 and 4, the valve body (21) has grooves (20) to accept various sized "O" rings (8) to ensure a tight seal when employed. The upper portion of the elongated valve stem (3) has an adjustable valve stem collar (4) that is centered vertically, and bored. The adjustable valve stem collar is attachable to the elongated valve stem above the upper valve stem guide (5) for a wide variety of adjustments between the valve body (21) and valve seat (16). The bottom surface of the valve body (18) is axially centrally concave to ensure that escaping oil and gases will force the valve into the valve seat (16). Two resilient lower assembly seals (9) of rubber-like material that seal between the elongated tubular housing, and the inner well casing wall, sealing the oil and/or gases from leaking past the elongated tubular housing, forcing the flow of oil and/or natural gases through the inner chamber (15) of this device, and therefore ensures the reliability of this tool.

With specific reference to FIGS. 3 and 4, the lower housing member (2) is machined for four retractable set dies (10) that are held in place with shearable pins (11) that reside at the location shown in FIGS. 3 and 4, (11*a*). The upper valve stem guide (5) and lower valve stem guide (6) are threaded and separable for ease of installation and removal. The upper assembly housing member is reduced in diameter to form an interiorly projecting annular shoulder (17).

An embodiment of the present invention comprises a retrievable well blowout prevention apparatus designed for use in subterranean wells, including crude oil or natural gas wells. An embodiment of the well blowout prevention apparatus comprises an elongated tubular housing, the elongated tubular housing having a threaded end portion (23), illustrated in FIG. 3, for connecting said housing in a production pipe-string to a well head.

Some embodiments have internal grooves (24) in the upper housing member (1), illustrated in FIG. 4, the internal grooves being adapted to suspending the well blowout prevention apparatus inside a well. Suspending the elongated tubular housing in a well facilitates independent placement of the well blowout prevention apparatus at any depth in a cased oil or natural gas well bore. In some embodiments, the well blowout prevention apparatus is placed above the well casing perforations. The internal grooves include, but are not limited to, "J-LOCK" configurations.

An embodiment of the elongated tubular housing comprises a threaded upper housing member (1) that screws together with a threaded lower housing member (2). Some embodiments further comprise two threaded pins (7) that prevent separation of the upper housing member from the lower housing member.

An embodiment further comprise four retractable set dies (10) with shearable pins (11) (11*a*), and two double grooved seals (9) that reside on the outside of the lower housing member. The double grooved seals (9) of some embodiments ensure that oil, gas, or other fluid moves through an inner chamber (15) of the elongated tubular housing.

As illustrated in FIGS. 3 and 4, embodiments further comprise a valve assembly disposed inside the inner chamber (15), the valve assembly comprising a valve seat (16), valve body (21), valve stem (3), and an adjustable valve stem collar (4), the adjustable valve stem collar being reversibly affixed to the valve stem with a shearable screw or shearable pin (22). The valve body of this embodiment further comprises grooves (20) adapted to accept O-rings (8), the O-rings being adapted to ensure a tight seal against the valve seat.

An embodiment further comprises upper valve guides (5) and lower valve guides (6), the upper and lower valve guides having bearing sleeves. The valve stem of some embodiments is located centrally in the inner chamber and resides along the bearing sleeves to allow reciprocal movement of the valve stem. Where an embodiment is disposed in a well, the valve body of this embodiment is adapted to being forced upwardly by a flow of fluid up through the inner chamber. The valve body of this embodiment is further adapted to being forced into the valve seat by the relative vacuum created when the upward flow of fluid reaches a predetermined rate, thereby substantially impeding or prohibiting release of the fluid into the atmosphere.

Obviously, the invention is susceptible to changes or alterations without defeating its practicability or departing from its spirit. Therefore, I do not want to be confined to the preferred embodiments shown in the drawings and described herein.

I claim:

1. A well blowout prevention apparatus comprising:

an elongated tubular housing adapted to insertion inside a well casing, the elongated tubular housing comprising:

an upper housing member and a lower housing member, wherein, (i) one of the upper housing member and the lower housing member has male threads, and the other of the upper housing member and the lower housing member has female threads, and (ii) the upper housing member connects to the lower housing member by engagement of the male threads with the female threads; and an anchoring mechanism, wherein:

rotating the upper housing member in a first direction relative to the lower housing member screws the upper and lower housing members together and exerts anchoring force on the anchoring mechanism, the anchoring force being adapted to cause the anchoring mechanism to engage an inner well casing wall, where the elongated tubular housing is located inside the well casing; and the anchoring mechanism is adapted to (i) secure the elongated tubular housing inside the well casing, and, (ii) substantially disengage from the inner well casing wall when the anchoring force on the anchoring mechanism is substantially relieved by rotating the upper housing member in a second direction relative to the lower housing member; and a valve assembly, the valve assembly being, (i) disposed inside the elongated tubular housing, and, (ii) adapted to substantially prohibit fluid flow that exceeds a threshold rate from flowing up through the elongated tubular housing.

2. The well blowout prevention apparatus of claim 1, wherein the anchoring mechanism comprises one or more set dies.

3. The well blowout prevention apparatus of claim 2, wherein rotating the upper housing member in the second direction relative to the lower housing member relieves the anchoring force on the one or more set dies and allows the one or more set dies to substantially retract inwardly along a radial axis of the elongated tubular housing.

4. The well blowout prevention apparatus of claim 2, further comprising one or more shear pins that hold the one or more set dies in position, wherein the anchoring mechanism is adapted to substantially disengage from the inner well casing wall by application of a substantial downward force to the elongated tubular housing, the substantial downward force causing one or more of the one or more shear pins to shear, and the anchoring force to diminish.

5. The well blowout prevention apparatus of claim 1, further comprising a housing member securing device adapted to prevent the upper housing member from separating from the lower housing member, while and/or after the upper housing member is rotated in a second direction relative to the lower housing member to substantially relieve the anchoring force on the anchoring device.

6. The well blowout prevention apparatus of claim 5, wherein the housing member securing device is one or more threaded pins.

7. The well blowout prevention apparatus of claim 1, wherein the valve assembly comprises:

a valve seat; and a valve body, the valve body being adapted to fit substantially snugly into the valve seat; and a valve stem connected to the valve body; and one or more valve guides that hold the valve stem in line along a longitudinal axis substantially in the center of an inner chamber; and a valve stem collar, the valve stem collar being (i) adjustably affixed around the valve stem above one or more of the one or more valve guides, and, (ii) readily dislodged from the valve stem when the valve stem is struck substantially forcefully from above.

8. The well blowout prevention apparatus of claim 7, wherein the valve body comprises one or more grooves, the one or more grooves being adapted to hold sealing rings that facilitate a substantially tight seal between the valve body and the valve seat.

9. The well blowout prevention apparatus of claim 8, wherein sealing rings comprised of elastomeric material reside in the one or more grooves.

10. A well blowout prevention apparatus comprising:

an elongated tubular housing adapted to insertion inside a well casing, the elongated tubular housing comprising:

an upper housing member and a lower housing member, wherein the upper housing member is adapted to, (i) connect to the lower housing member, and, (ii) rotate relative to the lower housing member; and an anchoring means for securing the elongated tubular housing to an inner well casing wall, wherein rotating the upper housing member in a first direction relative to the lower housing member causes the anchoring means to engage the inner well casing wall, where the elongated tubular housing is located inside the well casing; and a valve assembly, the valve assembly comprising (i) an inner chamber, the inner chamber being a substantially hollow bore disposed inside the elongated tubular housing, (ii) a valve stem, (iii) a valve seat, and, (iv) a valve body comprising a substantially concave bottom surface, the valve body being adapted to fit into the valve seat to form a substantially fluid tight seal.

11. The well blowout prevention apparatus of claim 10, wherein the anchoring means is adapted to substantially disengage from the inner well casing wall when the upper housing member is rotated in a second direction relative to the lower housing member.

12. The well blowout prevention apparatus of claim 11, further comprising a housing member securing means, wherein the housing member securing means prevents the upper housing member from separating from the lower housing member when the upper housing member is rotated in a second direction relative to the lower housing member and the anchoring means is disengaged from the inner well casing wall.

13. A method of using a well blowout prevention apparatus, comprising:

providing a well blowout prevention apparatus, the well blowout prevention apparatus comprising:

an elongated tubular housing adapted to insertion inside a well casing, the elongated tubular housing comprising:

an upper housing member and a lower housing member, wherein, (i) one of the upper housing member and the lower housing member has male threads and the other of the upper housing member and the lower housing member has female threads, and (ii) the upper housing member connects to the lower housing member by engagement of the male threads with the female threads; and an anchoring mechanism adapted to securing the elongated tubular housing inside the well casing, wherein rotating the upper housing member relative to the lower housing member screws the upper and lower housing members together and exerts anchoring force on the anchoring mechanism, the anchoring force being adapted to causing the anchoring mechanism to engage the well casing, where the elongated tubular housing is located inside the well casing; and a valve assembly the valve assembly being (i) disposed inside the elongated tubular housing, and, (ii) adapted to substantially prohibit fluid flow that exceeds a threshold rate from flowing up through the elongated tubular housing; and placing the well blowout prevention apparatus at a desired level inside a well casing inside a subterranean well; and rotating the upper housing member relative to the lower housing member to screw the upper and lower housing members together and secure the anchoring mechanism of the apparatus to the inside of the well casing; and providing an instrument adapted to engage the upper housing member; and securing the instrument to the upper housing member of the elongated tubular housing; and using the instrument to unscrew the upper housing member from the lower housing member to relieve the anchoring force on the anchoring device; and removing the well blowout prevention apparatus from the subterranean well.

14. The method of claim 13, wherein the instrument adapted to engage the upper housing member is a pipe-string.

15. The method of claim 14, further comprising:

knocking the valve stem out the bottom of the valve assembly by forcefully striking the valve stem from above to dislodge an adjustable valve collar from the valve stem.

* * * * *